US010947019B2

(12) United States Patent
Ban

(10) Patent No.: US 10,947,019 B2
(45) Date of Patent: Mar. 16, 2021

(54) PORTABLE BEVERAGE CONTAINER

(71) Applicant: Takeya Chemical Industry Co., Ltd., Habikino (JP)

(72) Inventor: Yukio Ban, Osaka (JP)

(73) Assignee: Takeya Chemical Industry Co., Ltd., Habikino (JP)

( * ) Notice: Subject to any disclaimer, the term of this patent is extended or adjusted under 35 U.S.C. 154(b) by 130 days.

(21) Appl. No.: 16/172,619

(22) Filed: Oct. 26, 2018

(65) Prior Publication Data

US 2019/0127130 A1 May 2, 2019

(30) Foreign Application Priority Data

Oct. 27, 2017 (JP) ..... JP2017-207817

(51) Int. Cl.

| | |
|---|---|
| ***B65D 47/12*** | (2006.01) |
| ***B65D 81/38*** | (2006.01) |
| ***B65D 43/02*** | (2006.01) |
| ***B65D 53/02*** | (2006.01) |
| ***B65D 47/14*** | (2006.01) |
| ***A47G 19/22*** | (2006.01) |
| ***A45F 3/18*** | (2006.01) |
| *B65D 51/24* | (2006.01) |

(52) U.S. Cl.

CPC ..... *B65D 47/122* (2013.01); *A45F 3/18* (2013.01); *A47G 19/2211* (2013.01); *B65D 43/0231* (2013.01); *B65D 47/142* (2013.01); *B65D 53/02* (2013.01); *B65D 81/3869* (2013.01); *B65D 51/242* (2013.01); *B65D 2543/00046* (2013.01); *B65D 2543/00537* (2013.01)

(58) Field of Classification Search

CPC ..... A45F 3/18; A47G 19/2211; A47G 21/188; A47J 31/005; A47J 31/02; B65D 2543/00046; B65D 2543/00537; B65D 43/0231; B65D 47/122; B65D 47/142; B65D 51/242; B65D 53/02; B65D 81/3869; B65D 51/2835

See application file for complete search history.

(56) References Cited

U.S. PATENT DOCUMENTS 4,194,627 A * 3/1980 Christensen ..... B65D 25/34 206/545
4,736,599 A * 4/1988 Siegel ..... B65D 25/02 126/263.05
5,203,467 A * 4/1993 Tucker ..... B65D 43/0212 220/254.3

(Continued)

OTHER PUBLICATIONS

International Search Report and Written Opinion on co-pending PCT application (PCT/US2018/057867) from International Searching Authority (US) dated Jan. 18, 2019.

*Primary Examiner* — Shawn M Braden

(74) *Attorney, Agent, or Firm* — Klein, O'Neill & Singh, LLP

(57) ABSTRACT

A portable beverage container having a lid member attached to a container vessel. The lid member can have a lid wall and a skirt depending from the lid wall and defining a projection space. A drinking opening or a drinking spout is provided with the lid member, which can be covered by a spout cap. An ice guard can be included with the lid member. The ice guard can attach in a bore of the drinking spout or located over an opening to the bore of the drinking spout.

21 Claims, 6 Drawing Sheets

(56) References Cited

U.S. PATENT DOCUMENTS

| | | | | |
|---|---|---|---|---|
| 5,366,089 | A * | 11/1994 | Parker | A45C 11/20 206/546 |
| 8,307,755 | B2 * | 11/2012 | Shen | A47J 31/20 99/322 |
| 2003/0136803 | A1 | 7/2003 | Kuwano et al. | |
| 2008/0087624 | A1 * | 4/2008 | Buckley | A47G 23/16 215/230 |
| 2010/0170905 | A1 * | 7/2010 | Ingman | B65D 85/78 220/521 |
| 2011/0309092 | A1 * | 12/2011 | Gatta | A47G 19/2205 220/703 |
| 2013/0153085 | A1 * | 6/2013 | Shefler | B65D 1/04 141/9 |
| 2014/0091113 | A1 * | 4/2014 | Brewster | B65D 47/24 222/525 |
| 2014/0339177 | A1 | 11/2014 | Lane | |
| 2015/0202554 | A1 | 7/2015 | Ben-Ezra | |
| 2015/0223628 | A1 * | 8/2015 | Cheung | A47J 31/005 99/296 |
| 2016/0075477 | A1 * | 3/2016 | Halioua | A47J 31/446 222/566 |
| 2016/0318693 | A1 | 11/2016 | Hein et al. | |
| 2017/0341831 | A1 * | 11/2017 | Hoffman | B65D 85/72 |
| 2017/0354289 | A1 * | 12/2017 | Marina | A47J 31/407 |
| 2018/0072473 | A1 * | 3/2018 | Salerno | B65D 47/247 |
| 2018/0178958 | A1 * | 6/2018 | Irizarry | A61J 11/04 |
| 2018/0184828 | A1 * | 7/2018 | Hodgins | A47G 21/188 |

* cited by examiner

PORTABLE BEVERAGE CONTAINER

FIELD OF ART

The present invention relates to embodiments of a portable beverage container with specific discussions on containers having a container main body and a lid and related methods.

BACKGROUND

There are many portable beverage containers of all shapes and sizes. Conventional portable beverage containers typically have a lid attached to a base, which can also be referred to as a container main body or container vessel, for holding quantity of fluid or beverage. The base can have a single wall or can be double-walled or insulated, which is typically assembled with a vacuum between the inner and outer wall layers and sealed along the top opening, which typically has a threaded end for threadedly engaging the lid. The double walls are generally made from stainless steel material and a sealable port can be provided at the base bottom for drawing a vacuum before sealing the port.

The lid can functions as an enclosure that opens and closes the threaded end of the container base, such as for adding or dispensing contents in and out of the interior defined by the container base. In other examples, the lid can have a drinking spout and the lid can thread to the base. A separate spout cap can then be incorporated to close the opening of the drinking spout. The spout cap can open and close the opening of the drinking spout to enable dispensing the contents of the container via the drinking spout.

Furthermore, portable beverage containers are known in which an ice outflow prevention part is provided in the drinking spout for preventing the ice from flowing out through the spout when a beverage with ice is contained inside the beverage container. Where or when provided, ice outflow prevention parts are known to have problems, such as being poorly designed and a source for tangling or gathering up ice that can then lead to restriction or obstruction of fluid outflow.

SUMMARY

Portable beverage container embodiments according to aspects of the present invention comprises a base, a container vessel, or a beverage container main body having an open end and a lid member engageable with the open end, wherein the lid member has a drinking spout for allowing beverage to flow from an interior of the container vessel to an exterior of the container vessel. In an example, the lid member comprises an ice outflow prevention part or ice guard sized and shaped to prevent ice from flowing out from inside the beverage container when said beverage container main body is tilted after a beverage containing ice has been placed therein. In an example, the ice outflow prevention part is integrally formed with the drinking spout, such as being co-molded with or bonded to the drinking spout, such as to the interior surface defining the bore of the spout, at the perimeter to the opening of the spout bore, or adjacent the perimeter defining the opening to the spout bore. In other examples, the ice outflow prevention part or ice guard is removably secured to the spout, such as to the surface defining the bore of the drinking pout, at the perimeter to the opening of the spout bore, or adjacent the perimeter defining the opening to the spout bore, to prevent ice from flowing out from inside the beverage container when the beverage container main body is tilted, such as when a user tilts the portable beverage container to take a drink. The ice outflow prevention part can snap fit with the spout, can thread to the spout, can interference fit with the spout, can frictionally engage with the spout, or combinations thereof.

In an example, the ice outflow prevention part in accordance with aspects of the invention comprises three or more plate parts arranged radially from a central axis of the spout, said ice outflow prevention part can have a structure with a shape that protrudes from a surface defined by an interior surface of the lid wall of the lid and into the beverage holding space. The protruding part of the plate parts can have a lower edge line, elevation-wise in the normal portable beverage container upright position, formed with a curvilinear or rectilinear shape sloping from a central part in the radially outward direction, whereby, when said beverage container main body is tilted, the ice is guided in the radially outward direction so as not to gather to restrict or block the flow through the drinking spout. The term plate part is understood to embody a plate-like structure in which a wall having two opposing surfaces and a thickness therebetween is used as a baffle to guard or prevent the ice from blocking and/or pouring out the drinking spout from inside the container vessel when the portable beverage container is titled and used.

With the portable beverage container in accordance with aspects of the present invention, even when a beverage containing ice is placed into the container and the container is tilted, the ice is guided in a radially outward direction of the ice guard, thus allowing the beverage to flow out smoothly without the ice interfering with the flow.

A further aspect of the invention is a portable beverage container comprising a lid member comprising a lid wall and a skirt depending from the lid wall; said lid wall comprising an upper surface and an underside surface opposing the upper surface, the underside surface defining an underside surface plane; a projection space defined by the skirt and the underside surface; a drinking spout formed with the lid wall, said drinking spout having a first opening at a first end of the drinking spout accessible from the projection space and a second opening at a second end of the drinking spout, where fluid can be dispensed, said drinking spout comprising a bore; a spout cap disposed over the drinking spout to close access to the second end of the drinking spout; an ice guard positioned over the first opening, in the bore of the drinking spout, or both over the first opening and in the bore of the drinking spout, said ice guard comprising a plurality of plate parts extending radially of a central part; and wherein parts of the plate parts define an ice guard projection that projects into the projection space and below, elevation-wise, the underside surface plane when the lid member is in an upright position.

Broadly, a portable beverage container can include a lid member and a container vessel attached to the lid member. An ice guard can be provided with the lid member for blocking ice located inside the container vessel from flowing or pouring out of a drinking spout or drinking opening provided with the lid member. The ice guard can include a plurality of plate parts. Sections or parts of the plate parts, which define an ice guard projection, can project into an ice projection space.

A spout can surround the drinking spout. The spout cap can threadedly engage a threaded boss or can snap fit to a lid wall or skirt of the lid member, such as with a detent or a snap fitting.

The plurality of plate parts can comprise at least three plate parts that contact one another along the central part.

A container vessel can attach to the lid member, wherein the container vessel can comprise an open end and a closed end. The open end of the container vessel can comprise exterior threads for threading with interior threads formed with the skirt of the lid member.

The container vessel can be a double-walled container having a gap between two walls. The gap between two walls can be under a vacuum. In other examples, the vessel container is a single wall structure without any gap. The vessel container can be made from a stainless steel material. The vessel container can be provided in its raw stainless steel finish or can be coated, such as with paint, coating, and/or indicia.

The plurality of plate parts can comprise four plate parts arranged in a plus-shape (+) configuration.

The spout cap can comprise an open end and wherein the open end of the spout cap can engage a perimeter of the lid wall.

The spout cap can comprise an open end and wherein the open end of the spout cap can attach to a threaded boss located on the lid wall.

An insulator plate can attach to the lid member within a space defined by the skirt. The insulator plate can have a skirt. The skirt of the insulator plate can have a flange. The spout projection can be located radially inwardly of the skirt of the insulator plate.

An insulator cap can be located inside the spout cap. The insulator cap have a skirt. The skirt of the insulator cap can have a flange. A spout projection having a bore can be provided with the insulator cap.

The spout cap can be pivotably attached to a hinged part located at the lid wall, the skirt, or an intersection between the lid wall and the skirt.

The insulator plate can be secured within the skirt by a snap ring.

A further aspect of the invention is a method of making a portable beverage container. The method can comprise: forming a lid member comprising a lid wall and a skirt depending from the lid wall; said lid wall comprising an upper surface and an underside surface opposing the upper surface, the underside surface defining an underside surface plane; providing a projection space defined by the skirt and the underside surface; providing a drinking spout with the lid wall, said drinking spout having a first opening at a first end of the drinking spout accessible from the projection space and a second opening at a second end of the drinking spout, where fluid can be dispensed, said drinking spout comprising a bore; positioning a spout cap over the drinking spout to close access to the second end of the drinking spout in a drinking spout closed position; incorporating an ice guard with the lid member so that the ice guard is located over the first opening, in the bore of the drinking spout or both over the first opening and in the bore of the drinking spout, said ice guard comprising a plurality of plate parts extending radially of a central part; and wherein parts of the plate parts define an ice guard projection that projects into the projection space and below the underside surface plane when the lid member is in an upright position.

The method can include a step of removing the ice guard from the lid member.

The method can include a step of pivoting the spout can away from the drinking spout.

The method can include a step of tilting the container vessel from an upright position after moving the spout cap away from the drinking spout.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of a portable beverage container and components thereof provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
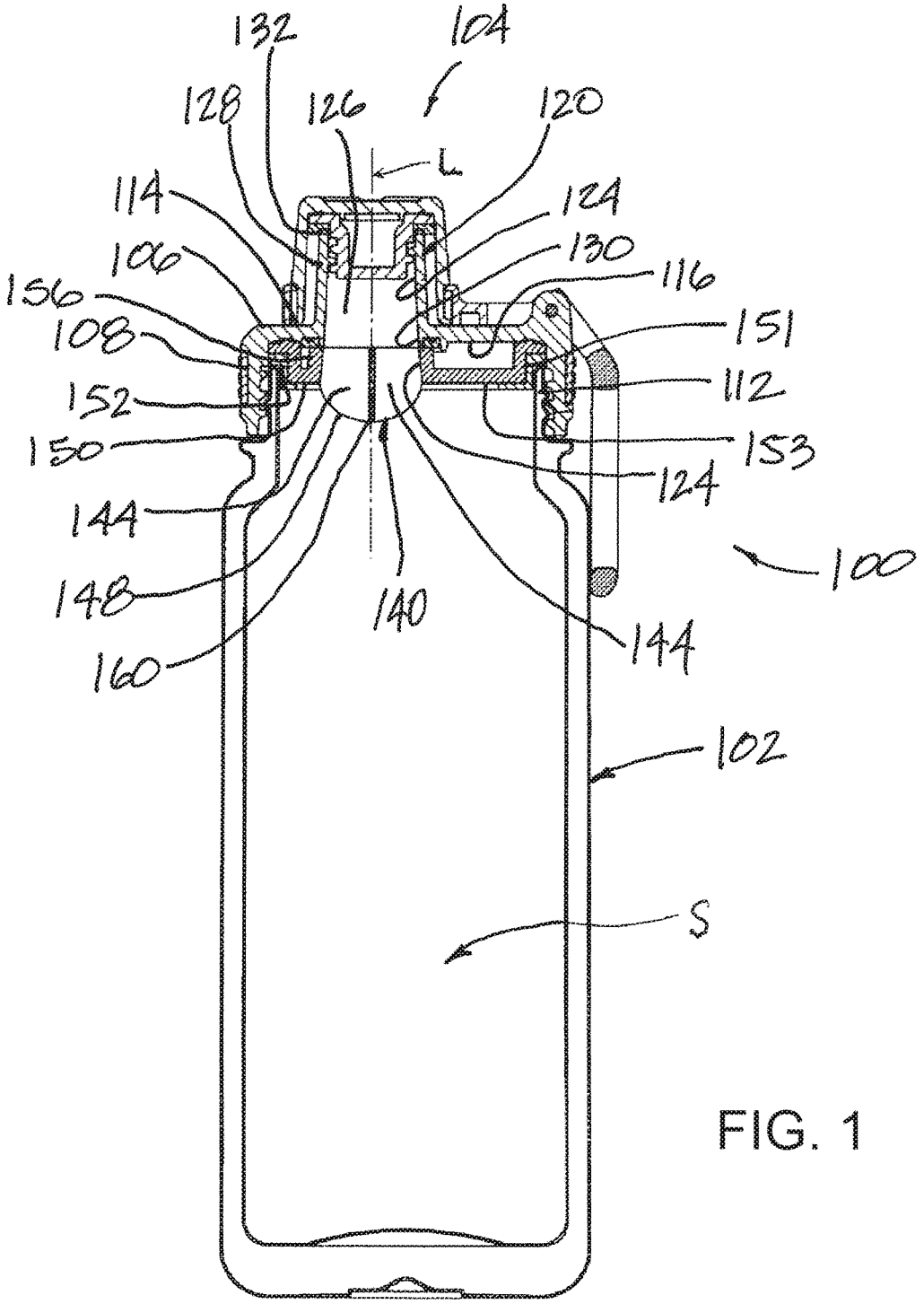
FIG. 1 is a cross-sectional front view showing invention portable beverage container comprising a container vessel and a lid member.

With reference now to FIG. 1, a portable beverage container 100 in accordance with aspects of the present invention is shown. In an example, the portable beverage container 100 comprises a beverage container main body, container vessel, or base 102 and a lid member 104, or lid for short. In an example, the container vessel 102 can have a single wall 102*a* or can have two walls 102*a* 102*b*, or double-walled. A gap can be provided between the two walls. The double-walled container vessel can be assembled with a vacuum between the inner wall 102*a* and the outer wall 102*b* and sealed along the top opening 112 of the container vessel, which typically has a threaded end for threadedly engaging the lid. The double walls are generally made from stainless steel material and a sealable port can be provided at the base bottom for drawing a vacuum before sealing the port. FIG. 1 shows the lid member and the container vessel in their respective upright position.

As shown, the lid member 104 has a lid wall 106 and a skirt 108 depending from the lid wall. The skirt 108 can have interior threads for threaded engagement with male threads at the top or open end 112 of the beverage container main body 102. In other examples, the skirt 108 can have male threads for projecting into the top end part or open end 112 of the base 102 to thread with female threads incorporated with the top end part of the base 102. The lid wall 106 can comprise a upper, top, first, or exposed surface 114 and a lower, second, underside, or interior surface 116.

In an example, the lid member 104 comprises a drinking spout 120 for allowing beverage to flow from the inside, holding space, or interior S of the beverage container main body 102 to the outside via the passage or bore 126 defined by an interior surface 124 of the drinking spout 120. In an example, the drinking spout 120 can have a tubular body 128 that extends above, elevation-wise, the upper or exposed surface 114 of the lid wall 106 and wherein the body 128 can be generally round. In a particular example, the drinking spout 120 has a perimeter defining a first open end 130 formed at the lid wall 106 and a perimeter defining a second open end 132 remote from the first open end. A spout length is defined between the first open end 130 and the second open end 132. In an example, the perimeter defining the first open end 130 is larger than the perimeter defining the second open end 132, which produces a spout body that tapers inwardly as the spout extends from the first open end 130 to the second open end 132, which can be viewed as the drinking end of the spout 120.

An ice outflow prevention part 140, or ice guard, is provided with the lid member 104. The ice guard or ice outflow prevention part 140 is configured to prevent ice E (see FIG. 3 through FIG. 5) from flowing out from the interior S of the main body 102 when the beverage container main body or base is tilted after a beverage containing ice has been placed therein, such as when used by a person to dispense the contents from inside the portable beverage container 100.

In an example, the ice outflow prevention part or ice guard 140 comprises three or more plate parts 144 arranged in-line with the passage or bore 126 of the spout 120 and extend in a radial direction relative to a central axis L of the bore 126. Although less than three or more than eight plate parts 144 may be utilized in an ice guard 140, too few of plate parts 144 can allow relatively large chunks of ice to pass through the drink passage or bore 126 or provide too large of gaps for larger ice to be stuck or caught between the plate parts to then negatively affect the flow volume through the drinking spout 120. Too large of a number of plate parts, such as more than eight, can also negatively affect flow through the drinking spout 120 by occupying too much of the free space of the bore 126, which can also restrict fluid flow.

In an example, an ice guard 140 in accordance with aspects of the invention can be integrally formed with the drinking spout 120, such as being molded with the lid member 104 and the spout 120. In alternative embodiments, the ice guard 140 can be separately formed and snap fit into the bore of the drinking spout. For example, the ice guard can be molded or welded to the interior surface defining the bore of the spout, at the perimeter to the opening of the spout bore, or adjacent the perimeter defining the opening to the spout bore. Broadly speaking, the ice guard can be located over the first opening of the bore, in the bore of the drinking spout or both over the first opening and in the bore of the drinking spout. As the bore 126 is tapered from the first end 130 to the second end 132, the ice guard 140 can have a corresponding outer contour as the bore 126 to enable a size on size fit, an interference fit, or a snap-fit arrangement inside the bore, and optionally with tabs or detents to more permanently secure the ice part to the spout. In accordance with aspects of the prevention, at least one part of the plate parts 144 must extend in the axial direction relative to the central axis L into the interior space S of the base 102 when the lid member 104 is secured to the container vessel 102. Said differently, at least part of the lower exterior contour or lower edge line 148, elevation-wise, of the ice guard 140 must extend out of the bore 126 of the lid member 104, away from the lower or interior surface 116 of the lid wall 106, opposite the direction of extension of the drinking spout.

In an embodiment, an optional insulator plate 150 is provided with the lid member 104. When included, the insulator plate 150 can attach to the lid 104 in the space defined by the skirt section 108 and the lid wall 106, such as the lower surface 116 of the lid wall 106. The insulator plate 150 can isolate an air gap or pocket between the insulator plate 150 and the lower surface 116 of the lid wall 106 to improve insulation along the path through the lid wall. In an example, the insulator plate 150 can be provided with a skirt 151 extending from an insulator wall 153 and having flange located at the end of the skirt 151 for contacting the lower surface 116 of the lid wall 106. A snap ring 152 can be used to secure against the skirt 108 of the lid 104 to retain the insulator plate 150 to the lid 104. The snap ring 152 can have an outside diameter for snapping against the interior surface of the skirt 108, such as in an interference fit, and an inside diameter to fit against the skirt 151 of the insulator plate 150. When incorporated, the insulator plate 150 is part of or a component of the lid member 104.

A spout projection 156 is provided with the insulator plate 150. The spout projection 156 can be viewed as a conduit or an extension of the drinking spout 120 of the lid 104 to form a continuous flow path between the lid 104 and the insulator plate 150. The spout projection 156 can have a body defining a bore and a flange at the remote end of the body for pressing against the lower surface 116 of the lid wall 106. In an embodiment, the spout projection 156 has an interior surface 124 defining a bore 126 that is aligned with the interior surface 124 and the bore 126 of the drinking spout 120. The bore 126 of the spout projection 156 can have a matching taper as the bore 126 of the drinking spout 120. In other examples, the bore 126 of the spout projection 156 can have a different taper, no taper, and/or different bore diameter than the bore of the drinking spout. When the insulator plate 150 is incorporated, the drinking spout 120 can be viewed as having a body 128 with a first open end 130 defined at the insulator wall 153 and a second open end 132 at the upper-most part of the body 128 of the drinking spout. The bore 126 of the drinking spout 120 is defined by the interior surface 124 of both the lid 104 and the insulator plate 150, when the latter is utilized.

Figure 1A:
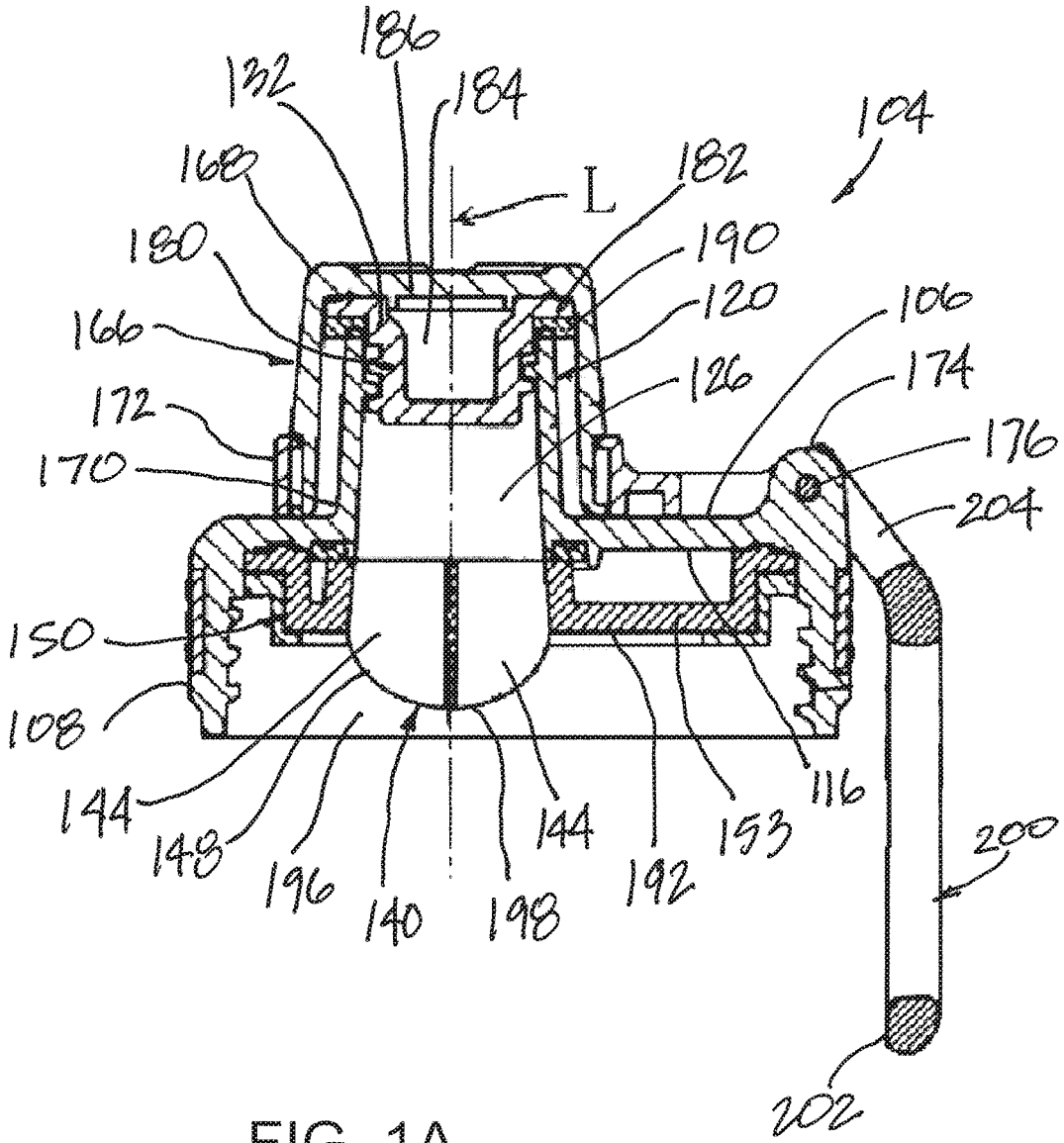
FIG. 1A is a cross-sectional front view showing the lid member of FIG. 1, without a container vessel.

FIG. 1A shows the lid member 104 of FIG. 1 without the beverage container main body or base 102. The lid member 104 is shown with a spout cap 166 for closing the second open end 132 of the spout 120. In an example, the spout cap 166 comprises a body 168 having a wall defining an interior for accommodating the drinking spout 120. The spout cap 166 can be threaded to corresponding threads at the base 170 of the drinking spout 120 or at the second end 132 of the spout to seal in the second open end of the spout 120. In the example shown, a threaded boss 172 is provided with the lid wall 106 for threaded engagement with the spout cap 166. In other words, the threaded boss 172 can elevate above the lid wall and the spout cap threaded to the threaded boss to close the opening of the drinking spout. FIG. 1A shows the spout can closed over the drinking spout in a drinking spout closed position.

In still yet other examples, the threaded boss 172 is a ring that retains the spout cap 166 so that the spout cap is rotatable relative to the ring 172. The ring, as an alternative to the threaded boss 172, can have legs or extensions that extend toward the projection 174 at an end of the lid wall 106 and are pivotably attached to the projection 174 via the pivot pin 176. The projection 174 for receiving the pivot pin 176 can be referred to as a hinged-part that enables pivoting connection with the spout cap. This arrangement allows the spout cap 166 to threadedly engage the drinking spout 120, by allowing the spout cap to rotate relative to the ring 172 to engage the threads on the spout 120. To dispense fluids from the spout 120, the spout cap 166 is first unthreaded from the spout 120, then the spout cap 166 and the ring assembly 172, as an alternative to the disclosed threaded boss, can pivot about the pivot pion 176 to pivot away from the second open end 132 of the spout to allow access to the second end, or for the contents to be dispensed from the second open end.

In an example, an insulator cap 180 is located inside the spout cap 166 to provide insulation for the spout cap. The insulator cap 180 has a skirt section that fits within the bore 126 of the drinking spout 120 with a flange 182 at an end thereof for abutting again the interior surface of the cap wall 186 of the spout cap 166. The insulator cap 180 has a body for isolating an insulative air space 184 between the spout cap 166 and the body of the insulator cap 180. This arrangement reduces heat loss through the cap wall 186. The insulator cap 180 can be secured to the spout cap 166 via a snap ring or gasket ring 190, which can fit within annular space between the skirt of the insulator cap 180 and the skirt of the spout cap 166 in an interference fit.

In an alternative embodiment, the spout cap 166 has an opening that is sized and shaped to snap fit with a perimeter of the lid wall 106. The alternative spout cap 166 that snap fits with the perimeter of the lid wall 106 can have a hinge point or a projection for hinging to a hinge point on the top lid wall 106 that is located radially outside of the perimeter of the lid wall 106. That is, the modified spout cap can engage the lid wall and surrounds the perimeter of the lid wall, such as by detents and/or snap fittings, and be provided with pivoting means to permit pivoting between the modified spout cap and the lid wall. The pivoting means can be constructed off or remote from the perimeter of the lid wall, such as attached to the skirt of the lid member, to not interfere with the opening and closing between the modified spout cap and the lid wall. The pivoting means can comprise tabs, projections, and/or corresponding extensions on the modified lid spout cap and skirt section of the lid member that are coupled via a pivot pin.

A gasket or a raised surface can be provided in the interior of the modified spout cap to seal against the upper opening 132 of the drinking spout 120 and the modified spout can closes over the drinking spout and engages the lid wall.

In still other examples, the drinking spout 120 can be located at the geometric center of the lid wall 106, off-center of the lid wall as shown in FIG. 1A, or close to an edge near the intersection between the skirt 108 and the lid wall 106.

In yet other examples, rather than a drinking spout 120 with an elongated or raised body, the lid wall 106 can be provided with a through opening, or drinking opening, similar to a short stub or a simple opening, without an elongated spout body rising from the exterior surface of the lid wall. A modified cap can be incorporated to close the drinking opening and be hinged to the lid wall, such as to the skirt section 108 of the lid member.

A handle 200 having a ring section 202 and two spaced apart extensions 204 can extend from the ring section 202. Each extension 204 can be provided with a pivot hole and can be pivotably attached to the projection 174 via the pivot pin 176. The handle can pivot about the pivot pin 176 passing through the aligned holes of the two spaced apart extensions.

For reference purposes, the space defined by the skirt 108 of the lid member 104 and the underside surface 192 of the insulator wall 153 defines a projection space 196 for the plate parts 144 of the ice guard 140, particularly for the lower edge line 148 of the ice guard, to project into. The underside surface 192 can define an underside surface plane. Collectively, the sections or parts of the plate parts 144 that project axially away from the drinking spout 120 and away from underside surface 192 of the insulator plate 150, if incorporated, or away from the underside surface 116 of the lid wall 106, if the insulator plate 150 is not incorporated, can be called an ice guard projection 198. The underside surface 116 of the lid wall can define an underside surface plane and the underside surface of the insulator plate can define an underside surface plane. Preferably, all embodiments of the ice guard 140 described herein in accordance with aspects of the invention can have an ice guard projection 198 that projects axially away from the underside surface 116 of the lid wall 106 and/or the underside 192 of the insulator plate 150 and into the projection space 196. Whether the lid member incorporates an insulator plate 150 or not, the projection space 196 may be understood as the open space defined at least in part by the skirt 108, the underside surface 116 of the lid wall 106, and where the ice guard projection 198 can project and be exposed externally of any surface that defines the bore to the drinking spout.

Figure 2:
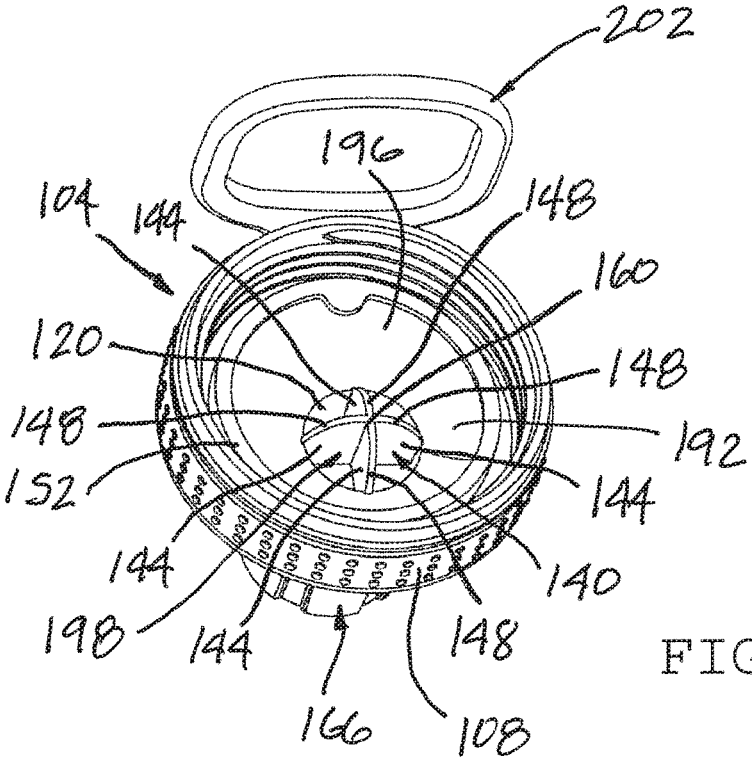
FIG. 2 is a bottom perspective view illustrating the lid member of FIG. 1A.

In an example and with reference to FIGS. 1A and 2, the ice outflow prevention part or ice guard 140 comprises four plate parts 144. From a bottom or top plan view of the ice guard 140, the four plate parts 144 can resemble a plus "+" sign when viewing along the top or bottom plan view with four plate parts 144 extending from a central part 160 at the center of the plus "+" configuration. The central part 160 can align with the central axis L of the drinking spout 120. The ice outflow prevention part 140 has a shape that protrudes into the projection space 196, towards and into the beverage holding space S when the lid member 104 is attached to the base or beverage container 102. That is, the ice guard 140 has an ice guard projection 198 that extends in the axial direction relative to the central axis L beyond or away from the inside, underside, or lower surface 192 of the insulator wall, when incorporated, or the lower surface of the lid wall when the insulator plate is not incorporated. The ice guard projection 198 can be considered projecting in a direction opposite the drinking spout 120.

The lower edge lines 148 of each of the plate parts 144 can be located externally of the space defined by the bore 126 of the insulator plate 150, if incorporated, and the bore 126 of the drinking spout 120 if the insulator plate is not incorporated. Said differently and when in the upright configuration shown in FIG. 1A, if the underside surface 192 of the insulator plate 150 defines a plane and the underside surface 116 of the lid wall 106 of the lid member 104 defines a plane, sections of the plate parts 144 and the lower edge lines 148 of the plate parts extend below, elevation-wise, of the two planes. Parts or sections of the plate parts 144 that extend below the two planes can be referred to as the ice guard projection 198. If the lid member 104 does not incorporate an insulator plate 150, parts or sections of the plate parts 144 that extend below the plane defined by the underside surface 116 of the lid wall 106 can be referred to as the ice guard projection 198.

Figure 3:
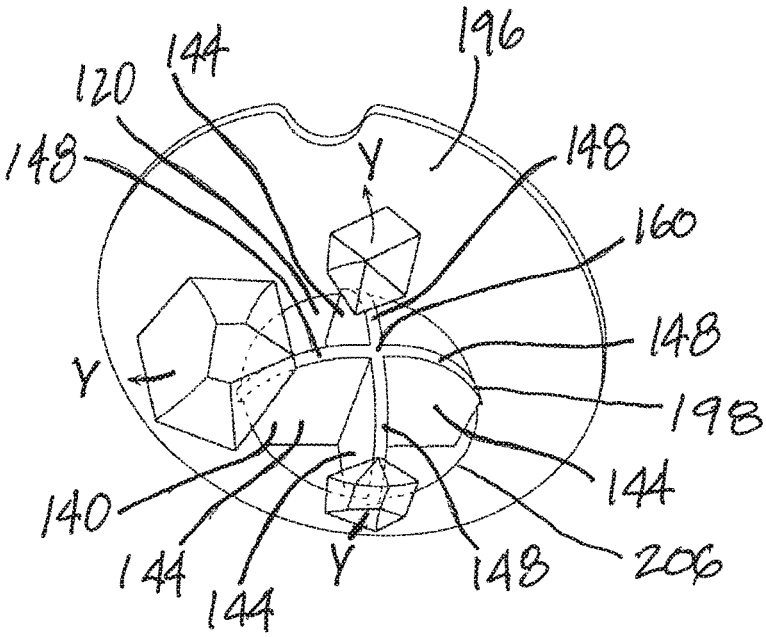
FIG. 3 is an enlarged schematic perspective view of the lid member of FIG. 2, shown without the container vessel, illustrating the ice outflow prevention part or ice guard in operation.

In an example, the lower edge lines 148 of the plate parts can be formed in a curvilinear or rectilinear shape sloping from the central part 160 in the radially outward direction The central part 160 can be viewed as a core or line representing an intersection of the four plate parts 144. When in use with a container vessel or beverage container 102 (FIGS. 1 and 3) and the beverage container is tilted, the ice E inside the holding space S of the beverage container 102 (FIG. 1) can be guided by the plate parts radially outward away from the central axis L defined by the drinking spout 120. As shown in FIG. 3, which shows the projection space 196 of the lid member 104, the contoured ends of the lower edge lines 148 of the plate parts, which can have a curvilinear shape or a rectilinear shape, causes the ice E to deflect in the direction of arrow Y, away from the central axis L.

As shown in FIG. 3, the physical presence of the ice guard projection 198 restricts or limits the ice E from occupying the same space as the ice guard projection 198. Thus, the ice E can be pushed laterally of the central part 160 thereby displacing the ice E from the opening 206 defining the bore 126 of the insulator plate 150, if incorporated, or the opening at the first open end 130 of the drinking spout 120 if no insulator plate 150 is incorporated. This configuration allows fluid to be dispensed out of the beverage container main body 102 without the ice E obstructing the flow by occupying part of the opening 206 or reducing the effective opening size of the insulator plate.

Figure 4:
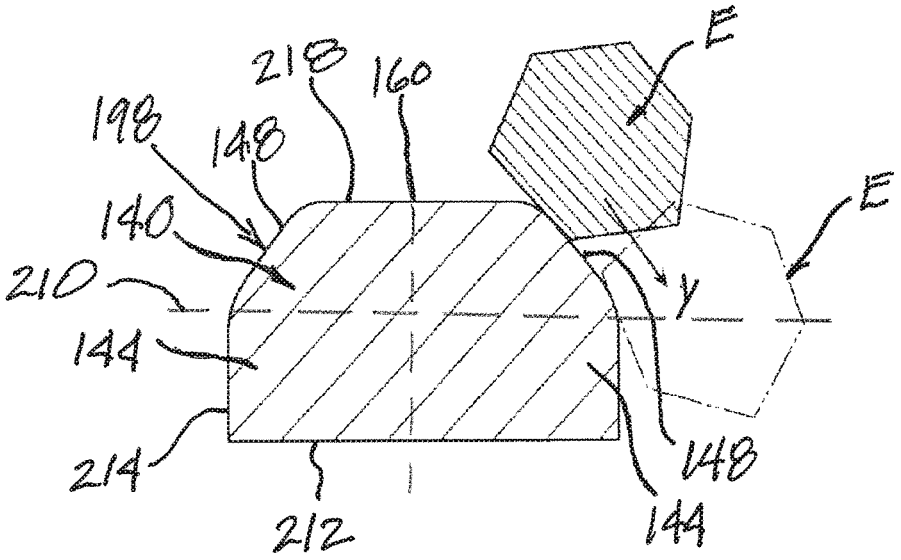
FIG. 4 is an enlarged schematic cross-sectional view of two adjacent plate parts, illustrating the operation of the ice outflow prevention part.

With reference now to FIG. 4, a cross-sectional view through two of the plate parts 144 of an ice guard 140 that are aligned generally along a same plane is shown. The vertical dashed line shown represents the central part 160 of an ice guard 140. The horizontal dashed line 210 represents a plane defined by the underside surface 192 of the insulator plate 150 or the underside surface 116 of the lid wall 106 of the lid member 104 when the ice guard 140 is positioned with the bore of the lid member 104. Sections or parts shown below the horizontal dashed line 210 are understood to be positioned inside the bore 126 of the insulator plate 150 or the bore 126 of the drinking spout 120. Sections or parts shown above the horizontal dashed line 210 are understood as the ice guard projection 198, as that term has been defined elsewhere herein. It should be noted that FIG. 4 illustrates an upside-down state. The ice plates 144 of FIGS. 1-3 can have the same shapes as the ice plates shown in FIG. 4.

In an example, each plate part 144 of the present ice guard embodiment comprises a base edge 212, a side edge 214, a slope edge 216, and a top edge 218. The slope edge 216 and the top edge 218 can form part of the ice guard projection 198. When ice E contacts the slope edge 216 and/or the top edge 218, ice E can be forced radially away from the central part 160 or falls to one side or the other from the top edge 218 away from the central part 160. Thus, the ice guard of the present embodiment having an ice guard projection 198 comprising a slope edge 216 and a top edge 218 is configured to direct ice E away from the central part 160 of the opening to the bore 128 to maintain a relatively free open flow path compared to ice guards not having the disclosed ice guard projection 198. The beverage container main body or base 102 has been omitted from FIGS. 3 and 4 for clarity but can be understood by referring to FIG. 1.

Figure 5:
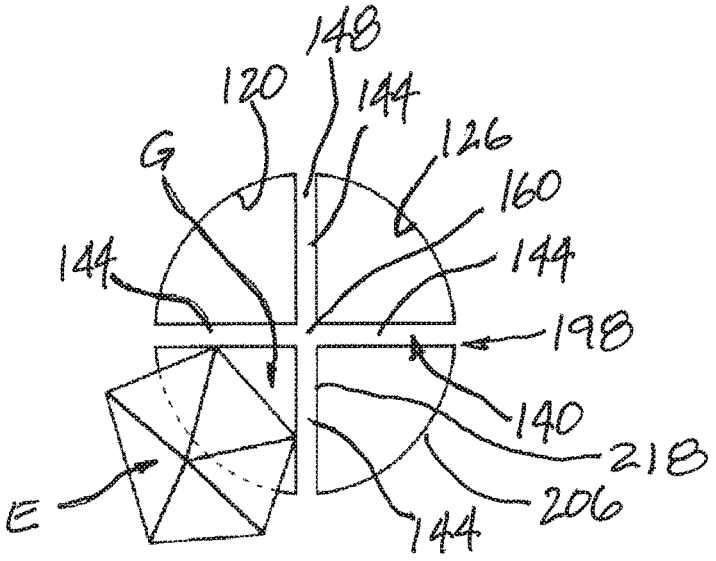
FIG. 5 is an enlarged schematic plan view of the major parts of the ice guard, illustrating the operation of the ice guard.

With reference now to FIG. 5 in addition to FIG. 4, a bottom plan view looking down the bore 126 and at the top edge 218 and the slope edge 216 of each plate part 144 of the ice guard 140 is shown. Also shown in the present drawing is the central part 160, four plate parts 144, the bore 126, and the opening 206 to the bore 126. The beverage container main body 102 has been omitted from FIG. 5 but can be understood from viewing FIG. 1.

In the FIG. 5 view, the ice guard projection 198, as described above and elsewhere, would protrude outward from the paper surface. When the beverage container main body 102 (see FIG. 1) is tilted after a beverage containing ice has been placed therein, the ice E contacts the plate parts 144 and a gap G between the plate parts and the ice E is exposed in the vicinity of the central part 160 thus allowing space or a channel for the beverage to flow out through the gap G towards the drinking spout 120 for dispensing.

As shown in FIG. 5, when a piece of ice E with a particular geometry comes in contact with the plate parts 144 of the ice guard 140, the ice can either be deflected radially away from the ice guard due to the curvilinear or rectilinear shape sloping edges of the lower edge lines 148 of the plate parts, can flow through the spaces between the plate parts 144 if small enough, or can be stuck between adjacent plate parts 144. However, even when the ice is stuck, there are still ample fluid flow gaps G for fluid to flow through by incorporating an ice guard projection 198 of the present embodiment. In other examples, by increasing the number of plate parts, such as from 4 to 5 or more, there can be more plate parts with additional curvilinear or rectilinear shape sloping edges of the lower edge lines 148 to deflect the ice E away from the ice guard 140.

Figure 6:
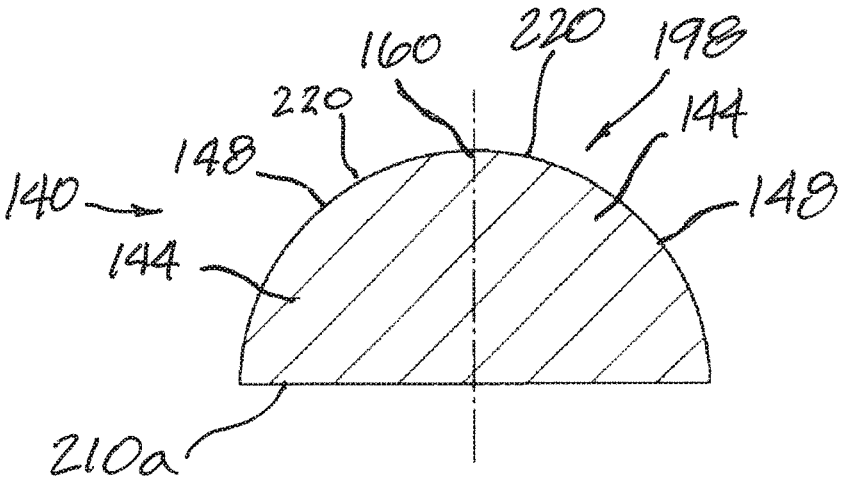
FIG. 6 is an enlarged cross-sectional view of two adjacent plate parts, illustrating a modified example of the ice outflow prevention part.

With reference now to FIG. 6, a cross-sectional view through two of the plate parts 144 of an ice guard 140 that are aligned generally along a same plane of an alternative embodiment is shown. The vertical dashed line shown represents the central part 160 of the ice guard 140. The lower edge 210*a* of FIG. 6 corresponds to the horizontal dashed line 210 of FIG. 4 and represents a plane defined by the underside surface 192 of the insulator plate 150 or the underside surface 116 of the lid wall 106 of the lid member 104 when the ice guard 140 is positioned with the bore of the lid member 104. In other words, parts of the ice guard 140 that sit inside the bore 126 of the insulator plate 150 or the bore of the drinking spout 120 to secure the ice guard or to assemble the ice guard with the lid member 104 is not shown in FIG. 6, unlike the details shown in FIG. 4. Only the parts of the ice guard 140 of FIG. 6 that project into the bore of the lid member 104, i.e., the ice guard projection 198, is shown and other than the different shapes can be similar to that shown in FIG. 4.

FIG. 6 shows the ice guard projection 198 of an alternative ice guard 140 embodiment. The lower edge lines 148 of the plate parts 144 of the ice guard can be formed in a curvilinear (arcuate) shape sloping in the radially outward direction from the central part 160. In an example, the lower edge line 148 of each plate part 144 is a curved lower edge 220 having a single radius of curvature. Two adjacent plate parts 144 can have two curved lower edges 220 that are continuous and resembles a half-circle. In other examples, the curved lower edge 220 can have a complex curve or a compound curve.

When ice E contacts the curved lower edge 220 of any of the plate parts 144, ice can be forced radially away from the central part 160 or falls to one side or the other from contacting the curved lower edge 220 of the ice guard and be directed away from the central part 160. Thus, the ice guard of the present embodiment having an ice guard projection 198 comprising a curved lower edge 220 can be configured to direct ice away from the central part 160 of the opening to the bore 128 to maintain a relatively free open flow path compared to ice guards not having the disclosed ice guard projection 198. The beverage container main body or base 102 has been omitted from FIG. 6 for clarity but can be understood by referring to FIG. 1.

Figure 7:
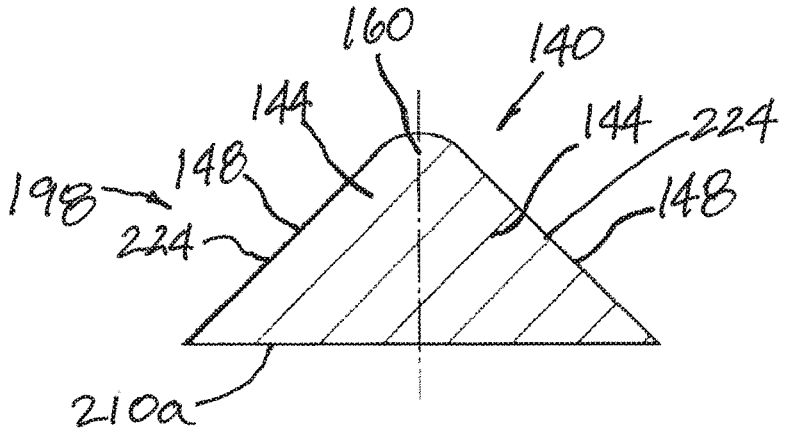
FIG. 7 is an enlarged cross-sectional view of two adjacent plate parts, illustrating another embodiment of the ice outflow prevention part.

With reference now to FIG. 7, a cross-sectional view through two of the plate parts 144 of an ice guard 140 that are aligned generally along a same plane of an alternative embodiment is shown. The vertical dashed line shown represents the central part 160 of the ice guard 140 of the present embodiment. The lower edge 210*a* of FIG. 7 corresponds to the horizontal dashed line 210 of FIG. 4 and represents a plane defined by the underside surface 192 of the insulator plate 150 or the underside surface 116 of the lid wall 106 of the lid member 104 when the ice guard 140 is positioned with the bore of the lid member 104. In other words, parts of the ice guard 140 that sit inside the bore 126 of the insulator plate 150 or the drinking spout 120 to secure the ice guard or to assemble the ice guard with the lid member 104 is not shown in FIG. 7, unlike the orientation shown in FIG. 4. The parts of the ice guard 140 of FIG. 7 that project into the bore of the id member 104 can be similar to that shown in FIG. 4.

FIG. 7 shows an ice guard projection 198 of an alternative ice guard 140 embodiment. The lower edge lines 148 of the plate parts 144 of the ice guard are formed in a rectilinear shape sloping in a radially outward direction from the central part 160. Viewing the central part 160, the sloping edge 224, and the horizontal line 210*a* of a single plate part, the plate part 144 has a generally triangular shape. The two plate parts 144 of FIG. 7 combined to resemble a cone shape top or a pyramid shape with a rounded peak.

When used as an ice guard of a lid member, ice E that contacts the sloping edge 224 of any of the plate parts 144 of the present embodiment is forced radially away from the central part 160 or falls to one side or the other from contacting the sloping edge 224 and directed away from the central part 160. Thus, the ice guard 140 of the present embodiment having an ice guard projection 198 comprising a sloping edge 224 is configured to direct ice away from the central part 160 of the opening to the bore 128 to maintain a relatively free open flow path compared to ice guards not having the disclosed ice guard projection 198. The beverage container main body or base 102 has been omitted from FIG. 7 for clarity but can be understood by referring to FIG. 1.

Figure 8:
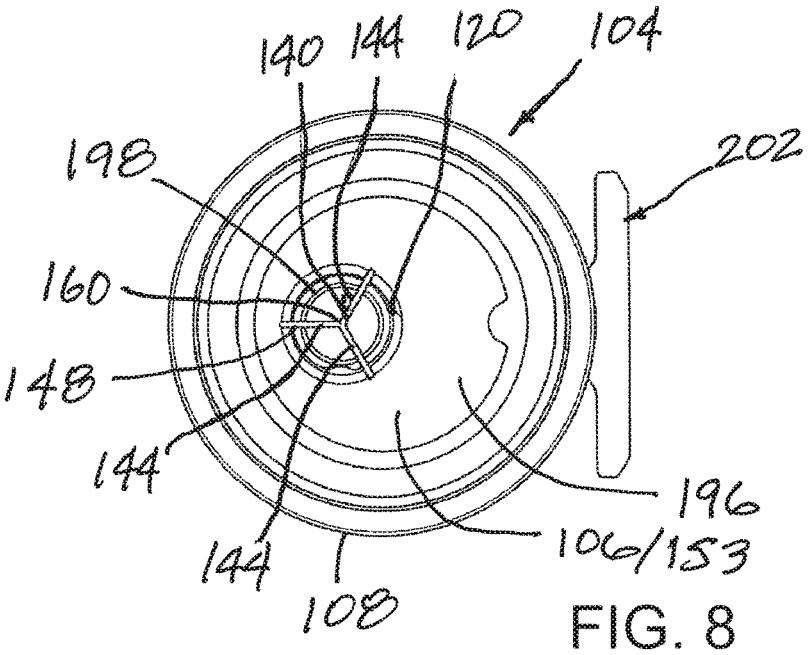
FIG. 8 is a bottom view illustrating an alternative lid member in accordance with further aspects of the invention.

With reference now to FIG. 8, a lid member 104 having an ice guard 140 located in a bore 126 and having an ice guard projection 198 that projects into a projection space 196 defined by a skirt 108 and a lid wall 106 or an insulator wall 153 is shown. In the present embodiment, the ice guard 140 can have three plate parts 144 and lower edge lines 148 that resemble any of the lower edge lines described elsewhere herein, such as those shown in FIGS. 4, 6, and 7. The lid member 104 can be similar to the lid member described with reference to FIGS. 1 and 1A.

Figure 9:
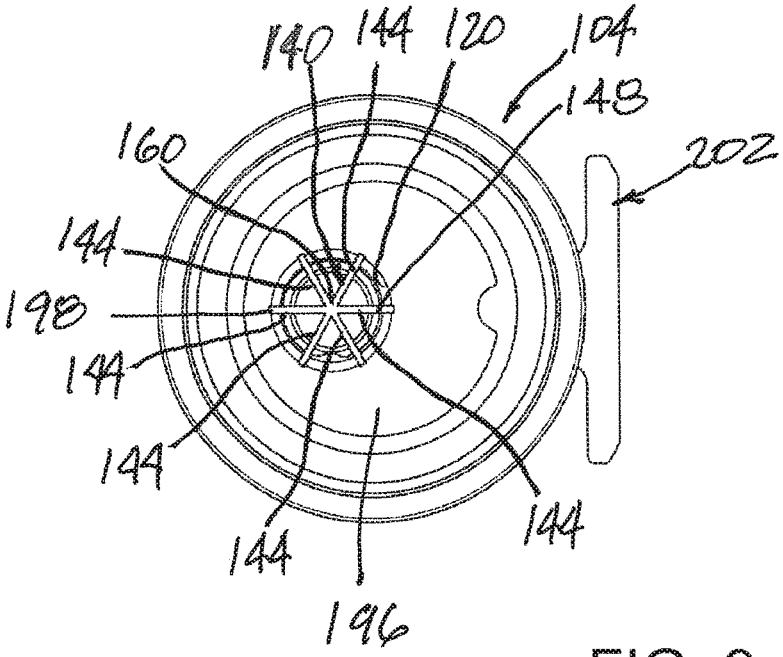
FIG. 9 is a bottom view illustrating another embodiment of a lid member in accordance with still further aspects of the invention.

With reference now to FIG. 9, a lid member 104 having an ice guard 140 located in a bore 126 and having an ice guard projection 198 that projects into a projection space 196 defined by a skirt 108 and a lid wall 106 or an insulator wall 153 is shown, similar to FIG. 8. In the present embodiment, the ice guard 140 can have six plate parts 144 and lower edge lines 148 that resemble any of the lower edge lines described elsewhere herein, such as those shown in FIGS. 4, 6, and 7. The lid member 104 can be similar to the lid member described with reference to FIGS. 1 and 1A.

Aspects of the present invention, as described above, are understood as being directed to a portable beverage container comprising a beverage container main body or container vessel 102 and a lid member 104, wherein said lid member 104 has a drinking spout 120 for allowing beverage to flow from inside the container main body to the outside of the beverage container main body. In an example, the drinking spout 120 can be equipped with an ice outflow prevention part or ice guard 140, which can be sized and shaped to prevent ice E from flowing out when said beverage container main body 102 is tilted after a beverage containing ice has been placed therein, and/or sized and shaped to direct ice E away from the opening inside the lid member to minimize or prevent flow obstruction.

In an example, the portable beverage container 100 is configured such that the ice outflow prevention part or ice guard 140 comprises three or more plate parts 144 arranged radially extending from a central axis L of the drinking port or the central part 160 of the ice guard. The ice outflow prevention part 140 can have an ice guard projection 198, or portions of the ice guard, that protrude out of the bore 126 of the lid member and into a projection space 196 of the lid member, which is defined at least in part by a skirt section 108 and an underside surface of the lid member, which can be a lid wall or an insulator wall. The ice guard projection 198 extending out of the bore and away from the drinking port can also be said to project into the beverage holding space S of the container main body 102 when the lid member is attached to the container main body.

In an example, the lower edge lines 148 of the plate parts 144 can be formed in a curvilinear or rectilinear shape sloping from said central part 160 in the radially outward direction, whereby, when said beverage container main body 102 is tilted, the ice E is guided in the radially outward direction, thereby allowing the beverage to flow out smoothly even when a beverage containing ice has been placed into the container, without the ice E catching on the ice outflow prevention part 4. The ice outflow prevention parts or ice guard 140 can also separate the outflow of beverage from the inflow of air, making the outflow of the beverage smoother.

In still other examples, the plate parts 144, such as those shown in FIGS. 6 and 7, can be molded, bonded, or welded to the lid member, at the bore or at the perimeter to the bore of the lid member, so that no part of the plate parts project into the bore of the lid member. In other words, the plate parts 144 can be attached to the perimeter or to surfaces adjacent the perimeter defining the bore of the dispensing opening or the drinking spout and no part, or substantially no part, of the ice guard projects into the bore. Instead, the plate parts are attached at the opening to the bore, such as to the perimeter defining the opening to the bore, and the ice guard projection 198 projects away from the bore, in the direction opposite the projection direction of the drinking spout.

Methods of making and of using portable beverage containers and components thereof, including different ice guards, are within the scope of the present invention.

Although limited embodiments of the portable beverage containers and their components have been specifically described and illustrated herein, many modifications and variations will be apparent to those skilled in the art. For example, the various container vessels may be made from plastic, the container vessels size can vary, the lid member and container vessel can be provided with colors and/or ornamentations, etc. Furthermore, it is understood and contemplated that features specifically discussed for one lid member and ice guard embodiment may be adopted for inclusion with another lid member and ice guard embodiment, provided the functions are compatible. For example, modifications or alternative embodiments described specifically with reference to one figure may be used or applicable in another embodiment shown in other figures. Accordingly, it is to be understood that the portable beverage containers and their components constructed according to principles of the disclosed device, system, and method may be embodied other than as specifically described herein. The disclosure is also defined in the following claims.

What is claimed is:

1. A portable beverage container comprising:

a lid member comprising a lid wall and a skirt depending from the lid wall; said lid wall, in an upright position, comprising an upper surface and an underside surface opposing the upper surface;

a projection space defined by the skirt and the underside surface;

a drinking spout formed with the lid wall, said drinking spout having a tubular body with a bore, a first opening, and a second opening, wherein the first opening has a circumference located within the lid wall such that the underside surface extends laterally all around the circumference of the first opening and the second opening is located above or remote from the upper surface of the lid wall and configure for dispensing fluid;

a spout cap disposed over the drinking spout such that the second opening of the drinking spout is located within an interior of the spout cap and access to the second opening is blocked;

an ice guard separately formed and positioned proximate the first opening or in the bore of the drinking spout, said ice guard comprising a plurality of plate parts extending radially of a central part, wherein each plate part comprises a wall having a base edge, a top edge, a length between the base edge and the top edge, and a thickness measured orthogonal to the length; and wherein an ice guard projection at an end of the ice guard is located in the projection space such that the top edge of each plate part and at least part of the central part of the ice guard, including part of the lengths of the plurality of plate parts, are exposed in the projection space below the first opening.

2. The portable beverage container of claim 1, wherein the plurality of plate parts comprises at least three plate parts that contact one another along the central part.

3. The portable beverage container of claim 2, further comprising a container vessel attached to the lid member, wherein the container vessel comprises an open end and a closed end.

4. The portable beverage container of claim 3, wherein the container vessel is a double-walled container having a gap between two walls.

5. The portable beverage container of claim 4, wherein the gap between two walls is under a vacuum.

6. The portable beverage container of claim 1, wherein the plurality of plate parts comprises four plate parts arranged in a plus-shape (+) configuration.

7. The portable beverage container of claim 1, wherein the spout cap comprises an open end and wherein the open end of the spout cap is pressed against the upper surface of the lid wall.

8. The portable beverage container of claim 1, wherein the spout cap comprises an open end and wherein the open end of the spout cap is attached to a threaded boss located on the lid wall.

9. The portable beverage container of claim 1, further comprising an insulator plate attached to the lid member within a space defined by the skirt, the insulator plate comprising an insulator wall that is generally parallel to the underside surface and a bore having the plurality of plate parts located in the bore of the insulator plate.

10. The portable beverage container of claim 9, wherein the bore of the insulator plate is aligned with the bore of the of the drinking spout.

11. The portable beverage container of claim 9, wherein the spout cap is pivotably attached to a hinged part located at the lid wall, the skirt, or an intersection between the lid wall and the skirt.

12. The portable beverage container of claim 9, wherein the insulator plate is secured within the skirt by a snap ring.

13. A method of making a portable beverage container comprising:

forming a lid member comprising a lid wall and a skirt depending from the lid wall; said lid wall, in an upright position, comprising an upper surface and an underside surface opposing the upper surface;

providing a projection space defined by the skirt and the underside surface;

providing a drinking spout with the lid wall, said drinking spout having a tubular body with a bore, a first opening, and a second opening, wherein the first opening is accessible from the projection space and the second opening is spaced from the upper surface of the lid member and configured to dispense fluid;

positioning a spout cap over the drinking spout such that the second opening is located within an interior of the spout cap to block access to the second opening;

incorporating an ice guard with the lid member so that the ice guard partially blocks the first opening or is in the bore of the drinking spout, said ice guard comprising a plurality of plate parts extending radially of a central part and each plate part comprising a lower edge line such that the plurality of plate parts comprises a plurality of lower edge lines; and wherein an ice guard projection at an end of the ice guard is located in the projection space such that the plurality of lower edge lines and the central part of the ice guard are located in the projection space below the first opening.

14. The method of claim 13, wherein the plurality of plate parts comprises at least three plate parts that contact one another along the central part.

15. The method of claim 14, further comprising a container vessel attached to the lid member, wherein the container vessel comprises an open end and a closed end.

16. The method of claim 15, wherein the container vessel is a double-walled container having a gap between two walls and wherein the gap between two walls is under a vacuum.

17. The method of claim 13, wherein the spout cap comprises an open end and wherein the open end of the spout cap is pressed against the lid wall.

18. The method of claim 13, further comprising an insulator plate attached to the lid member within a space defined by the skirt by a snap ring.

19. The method of claim 18, further comprising an insulator cap located inside the spout cap.

20. The method of claim 19, wherein the spout cap is pivotably attached to a hinged part located at the lid wall, the skirt, or an intersection between the lid wall and the skirt.

21. A portable beverage container comprising:

a lid member comprising a lid wall and a skirt depending from the lid wall; said lid wall, in an upright position, comprising an upper surface and an underside surface opposing the upper surface;

a projection space defined by the skirt and the underside surface of the lid wall;

a drinking spout formed with the lid wall, said drinking spout having a bore, a first opening accessible from the projection space and a second opening configured to dispense fluid;

a spout cap disposed over the drinking spout to close access to the second end of the drinking spout;

an ice guard partially blocking the first opening or located in the bore of the drinking spout, said ice guard comprising a plurality of plate parts intersecting at a central part of the drinking spout and extending radially outwardly from the first opening or from within the bore of the drinking spout; and an ice guard projection at an end of the ice guard is located in the projection space below the first opening of the drinking spout.

* * * * *